US005272875A

United States Patent [19]

Kaji

[11] Patent Number: 5,272,875

[45] Date of Patent: Dec. 28, 1993

[54] CATALYTIC CONVERTER FOR AN INTERNAL COMBUSTION ENGINE

[75] Inventor: Gozo Kaji, Higashikamo, Japan

[73] Assignee: Toyota Jidosha Kabushiki Kaisha, Toyota, Japan

[21] Appl. No.: 898,443

[22] Filed: Jun. 15, 1992

[30] Foreign Application Priority Data

Jun. 26, 1991 [JP] Japan ..... 3-154902

[51] Int. Cl.[5] ..... F01N 3/28

[52] U.S. Cl. ..... 60/299; 60/322; 422/179; 422/180

[58] Field of Search ..... 60/299, 322; 422/179, 422/180

[56] References Cited

U.S. PATENT DOCUMENTS 5,104,627 4/1992 Usui ..... 422/179

5,173,267 12/1992 Maus ..... 422/179

FOREIGN PATENT DOCUMENTS 2308220 9/1974 Fed. Rep. of Germany ..... 422/179

3433938 10/1985 Fed. Rep. of Germany ..... 422/179

1060712 3/1989 Japan ..... 422/179

219818U 2/1990 Japan .

2273548A 11/1990 Japan .

OTHER PUBLICATIONS

Ser. No. 07/612493, filed Nov. 14, 1990, to Kaji et al.

*Primary Examiner*—Douglas Hart

*Attorney, Agent, or Firm*—Kenyon & Kenyon

[57] ABSTRACT

A catalytic converter for use in the gas exhaust system of an internal combustion engine. The converter includes two honeycomb cores which are disposed in the direction of the exhaust gas flow in the gas exhaust. The honeycomb cores include a catalyst for purifying the exhaust gas. The converter also includes an outer tube for housing the honeycomb cores and an intermediate tube which is disposed between the outer tube and the honeycomb cores. The intermediate tube includes a plurality of flexible portions for absorbing dimensional variations in the honeycomb cores and the outer tube.

9 Claims, 6 Drawing Sheets

CATALYTIC CONVERTER FOR AN INTERNAL COMBUSTION ENGINE

BACKGROUND OF THE INVENTION

1. Field of the Invention

The present invention relates to a catalytic converter, and more particularly to a catalytic converter for use in an internal combustion engine exhaust system.

2. Description of the Related Art

A principal objective of catalytic converters is to regulate exhaust gases emitted from a vehicle without significantly increasing the energy consumption of the engine. A catalytic converter generally includes a catalytic substrate having a honeycomb structure with a plurality of small holes that are arranged systematically with respect to the flow direction of exhaust gas. Honeycomb substrates tend to minimize pressure losses and to improve the efficiency of the catalytic converter.

The temperature of the exhaust gas varies according to the engine operative conditions. More specifically, the exhaust gas is held at low temperature while starting and idling the engine. The temperature of the exhaust gas increases until it reaches normal operational temperatures. The method for efficiently purifying the exhaust gas, even at its maximum temperature, by employing catalytic converters, to meet the engine full load heat capacity, is known. Immediately after the engine is started, the exhaust gas throughput is small, and its temperature low.

Consequently, a catalytic reaction does not commence, since the catalyst temperature is not sufficiently high to cause undesirable elements, such as formaldehyde, to be treated and filtered by the catalatic converter. As a result, the exhaust gas becomes highly toxic at lower temperature. An attempt to improve the efficiency of the exhaust gas purification process, at low to normal temperatures, has been made, by installing several different heat capacity catalysts.

Japanese Unexamined Utility Model Publication Hei 2-19818 discloses a catalytic converter of this type. The catalytic converter has a substrate shown in FIG. 9, and two metal catalysts 100 and 101 of different capacities. These catalysts 100 and 101 are disposed within a tube 102 along the direction of flow of the exhaust gas emitted by the internal combustion engine. The catalyst 100 has a smaller capacity, and is designed to purify lower temperature exhaust gases. The catalyst 101 has a larger capacity and is designed to purify higher temperature exhaust gases. However, if the coefficient of thermal expansion of the catalysts 100 and 101 were greater than that of the tube 102, thermal stress could develop, and might cause damage to the catalysts 100 and 102. One attempted solution has been to increase the contractile strength of the catalysts 100 and 101, even though this will increase the weight of these catalysts. As a result, the installation of the catalytic converter in a vehicle becomes more difficult.

SUMMARY OF THE INVENTION

It is therefore an object of the present invention to provide a metal substrate for use in an exhaust gas purification catalytic converter.

To achieve the foregoing and other objects and in accordance with the purpose of the present invention, the catalytic converter is provided with two durable metal substrates used for withstanding the thermal stress caused by thermal deformation.

Another object of the present invention is to provide a catalytic converter which efficiently and effectively purifies and filters exhaust gases.

The present invention is characterized in that specially designed metallic substrates are used in the catalytic converter for purifying the exhaust gas. A pair of honeycomb cores with catalysts are secured inside an outer tube to purify the exhaust gases. These cores are coaxially disposed along to the direction of flow of the exhaust gases emitted by the internal combustion engine. The outer tube houses the honeycomb cores and an intermediate tube which is disposed between the outer tube and the honeycomb cores. The intermediate tube has two flexible ends designed to absorb dimensional variations in the honeycomb cores and the outer tube. Each end of the intermediate tube is secured to one honeycomb core, and the middle section of the intermediate tube is secured to the outer tube.

DETAILED DESCRIPTION OF THE PREFERRED EMBODIMENT

A preferred embodiment of a metal substrate for use in an catalytic converter for purifying exhaust gases, will now be described with reference to FIGS. 1 through 4.

Figure 1:
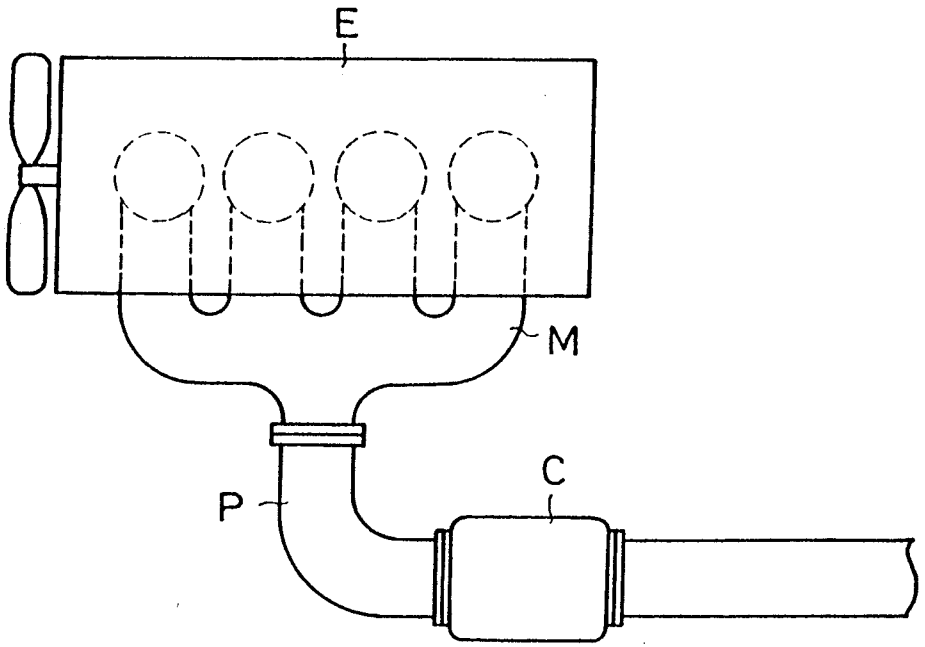
FIG. 1 is a schematic side view of a catalytic converter according to the present invention, shown installed in an exhaust gas system.

FIG. 1 shows an engine E fitted with a catalytic converter C. The catalytic converter C is connected to the bottom portion of a manifold M to purify the exhaust gas.

Figure 2:
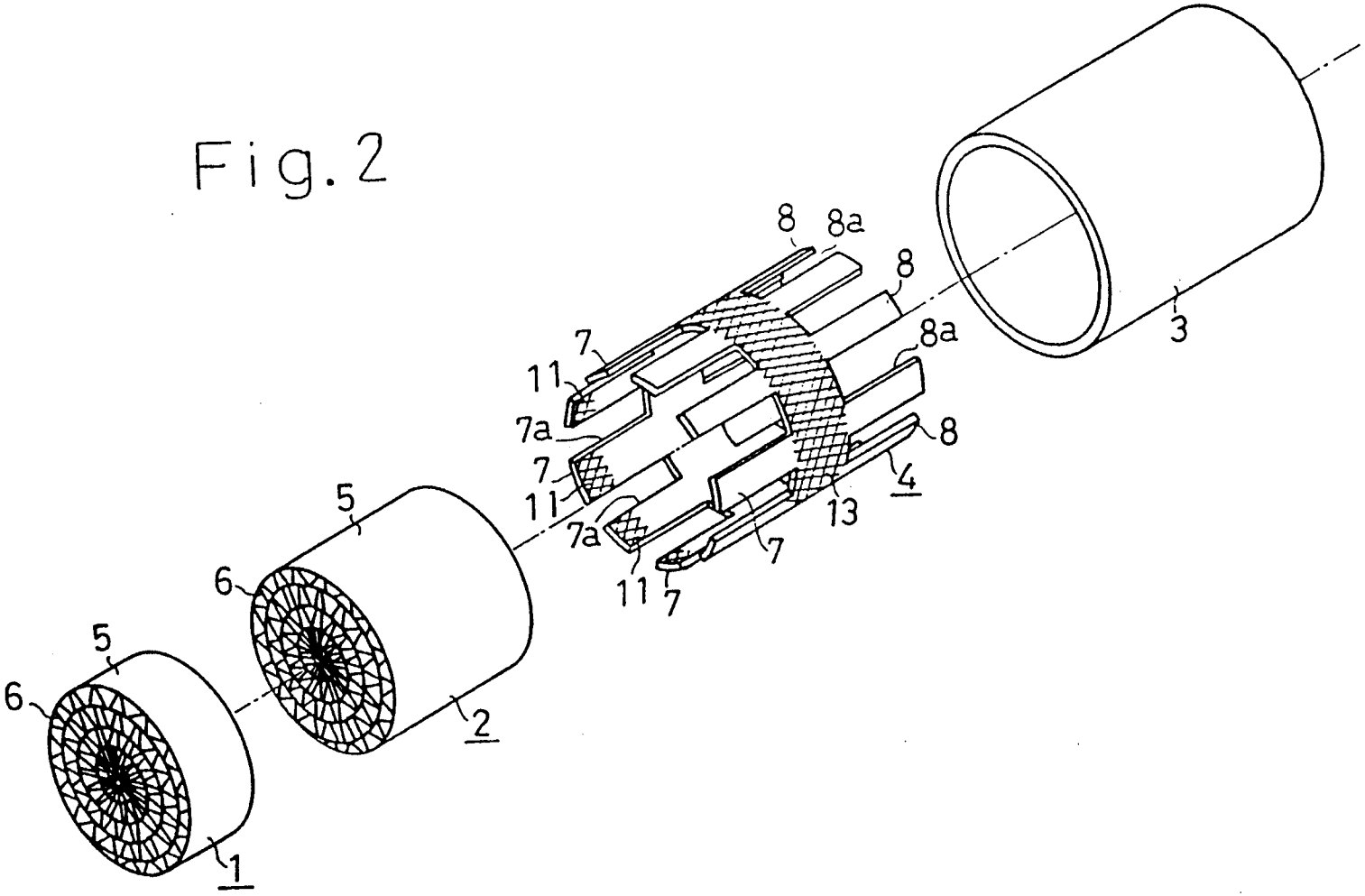
FIG. 2 is an exploded perspective view illustrating two honeycomb cores used in the catalytic converter of FIG. 1.
Figure 3:
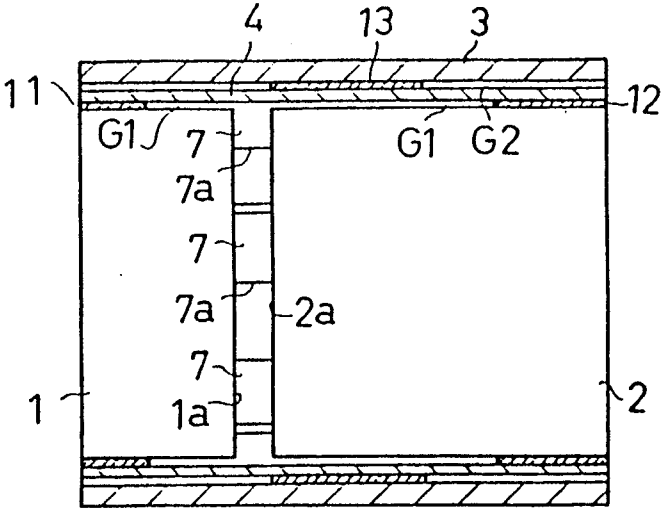
FIG. 3 is a sectional view of a catalytic converter using the honeycomb cores of FIG. 2.

FIGS. 2 and 3 show the constituent components of the catalytic converter C. The catalytic converter C includes two honeycomb cores 1 and 2, each of which is disposed at one end of the catalytic converter C. An outer tube 3 is concentrically disposed with, and houses the honeycomb cores 1 and 2. An intermediate tube 4 is disposed between the honeycomb cores 1, 2 and the outer tube 3. Each one of honeycomb cores 1 and 2 acts as a metal catalyst, and includes a plate 5 and a corrugated plate 6. The plates 5 and 6 are brazed together to form a unitary element which is spirally rolled into a generally cylindrical shape, with the plate 5 forming the outer surface. The plate 5 and the corrugated plate 6 are selected from a family of Fe-Cr-Al alloy materials. Each plate 5 and 6 has a thickness of about 0.05 mm. Each one of the honeycomb cores 1 and 2 is treated with a catalyst to help purify the exhaust gas.

The catalytic converter C has a proximal end which is closer to the manifold M, and an opposite distal end which is farther away from the manifold M, along the direction of flow of the exhaust gas. The capacity of the honeycomb core 1 is disposed at the proximal end of the converter C, while the honeycomb core 2 is disposed at the distal end thereof. The capacity or inner volume of the honeycomb core 1 is generally at most one half (½) the capacity of the honeycomb core 2. The honeycomb core 1 has a smaller heat capacity than the honeycomb core 2, and consequently it purifies low temperature exhaust gas, while the honeycomb core 2 more efficiently purifies the exhaust gas at normal temperatures.

The outer tube 3 has a generally cylindrical construction, and a ferritin stainless steel composition. Its thickness ranges between 1.0 mm to 2.0 mm. The intermediate tube 4 also has a generally cylindrical construction, and is composed of stainless steel or of an appropriate material selected from a family of Fe-Cr-Al alloy material. Its thickness ranges between 0.1 mm to 0.5 mm.

The intermediate tube 4 includes two opposite ends and a central section 10 adjoining both ends. Each end includes a plurality of axially extending flexible portions 7 and 8. The flexible portions 7 and 8 are interleaved with openings or notches 7*a* and 8*a*, and are distributed along the outer periphery of the intermediate tube 4. As further shown in FIG. 4, the intermediate tube 4 includes a generally flat plate 9 which is rolled into a cylindrical shape to form the intermediate tube 4. Prior to forming the notches 7*a* and 8*a*, the plate 9 has a generally flat and rectangular shape. The flexible portions 7 and 8 are spaced apart, and extend outwardly from the central section 10.

When the plate 9 is formed into the intermediate tube 4, the flexible portions 7 and 8 and the notches 7*a* and 8*a* are deformed unequally. Therefore, the flexible portions 7 and 8 allow the intermediate tube 4 to have a generally adaptable construction, since the diameters of the two end portions of the intermediate tube 4 can either increase or decrease in relation to the forces applied thereon.

The coefficient of linear thermal expansion of the intermediate tube 4 is about $13.5\times10^{-6}$/°C., that of the honeycomb core 1 is about $15\times10^{-6}$/°C., and that of the outer tube 3 is about $12\times10^{-6}$/°C. The values of the foregoing coefficients of linear thermal expansion are generally different, such that the inner most element has the smallest coefficient value, and the outermost element has the highest coefficient value. In this regard, the honeycomb core 1 has the lowest coefficient value, while the intermediate tube 4 has a higher coefficient value, and the outer tube 3 has the highest coefficient value. As mentioned above, the catalytic converter C has a proximal end and a distal end. Generally speaking, each element of the converter C has two opposite ends which will be described hereinafter, with respect to the proximal and distal ends of the converter C, for clarity and simplicity purpose. The intermediate tube 4 has a proximal and a distal end which are located adjacent to the proximal and distal ends of the outer tube 3, respectively, when the intermediate plate 4 is introduced within, and secured to the outer tube 3.

Similarly, each of the honeycomb cores 1 and 2 has a proximal and distal ends, such that the proximal end of the honeycomb core 1 is disposed adjacent to the proximal ends of the intermediate tube 4 and the outer tube 3, when the honeycomb core 1 is assembled within the intermediate tube 4. The distal of the honeycomb core 2 is disposed adjacent to the distal ends of the outer tube 3 and the intermediate tube 4, when the honeycomb core 2 is assembled within the intermediate tube 4. The terminal ends of the flexible portions 7 and 8 are brazed to the proximal end and to the distal end of the honeycomb cores 1 and 2, respectively. The center section 10 of the intermediate tube 4 is brazed to the inner circumferential peripheral surface of the middle portion of the outer tube 3, by means of a brazing material 13.

Figure 4:
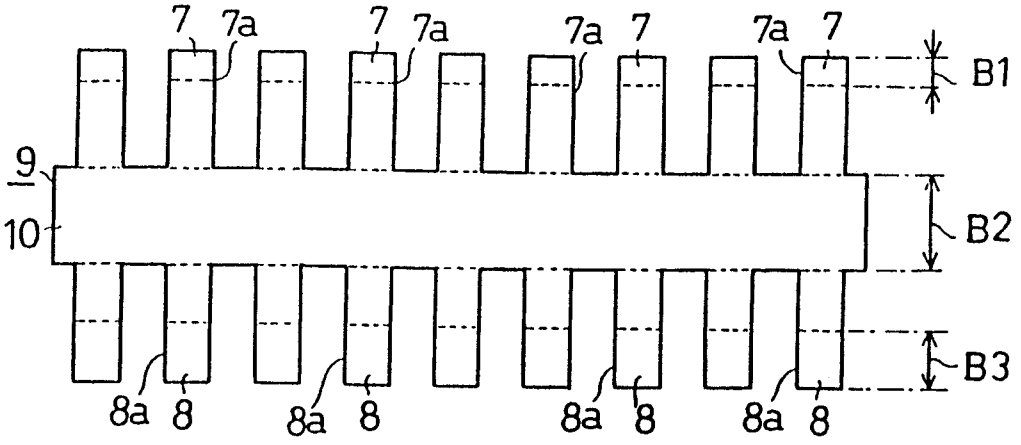
FIG. 4 is a plan view of an intermediate tube for use in the catalytic converter of FIG. 1, shown flattened.

Turning now to FIG. 4, R1 designates the regions on the proximal end of the intermediate tube 4, which are connected to the proximal end of the honeycomb core 1. R3 designates the regions on the distal end of the intermediate tube 4, which are connected to the distal end of the honeycomb core 2. R2 designates the central section of the intermediate tube 4, which is connected to the outer tube 3.

The regions R1, R2 and R3 are separated from each other, along the axial direction of the intermediate tube 4. The brazing materials 11 through 13 are applied onto and cover the regions R1, R2 and R3 of the intermediate tube 4 prior to brazing.

Consequently, each honeycomb core 1 and 2 has free one distal end. The honeycomb core 1 has its distal end 1*a* as the free end, while the honeycomb core 2 has its proximal end 2*a* as the free end. The free ends 1*a* and 2*a* are held facing each other. A space G1 is formed between the outer peripheral surfaces of each honeycomb core 1, 2 and the inner peripheral surface of the intermediate tube 4, and a space G2 between the inner circumferential peripheral surface of the outer tube 3 and the outer peripheral surface of the intermediate tube 4.

The operation of the catalytic converter C will now be described.

The honeycomb core 1 will react with, and purify the low temperature exhaust gas, almost immediately after the engine E is started. After the exhaust gas temperature rises with the temperature of the engine E, the honeycomb core 2 starts reacting with, and purifying the exhaust gas. Therefore, both honeycomb cores 1 and 2 purify the exhaust gas at low to normal operating temperatures.

The flexible portions 7 and 8 of the intermediate tube 4 become deformed in relation to the variable outer diameters of the honeycomb cores 1 and 2. These outer diameters increase with heat, and decrease when the cores 1 and 2 are cooled. In another words, the flexible portions 7 and 8 of the intermediate tube 4 absorb the radial expansion force of the honeycomb cores 1 and 2, and the radial shrinking force of the outer tube 3. The deformation of the proximal and distal ends of the intermediate tube 4 is not hindered by the outer tube 3, as these ends are not connected to the outer tube 3. Thermal stress, which is generated by thermal deformation between the honeycomb cores 1, 2 and the intermediate tube 4, is absorbed and relieved by the flexible portions 7 and 8.

The expansion of the intermediate tube 4 is regulated by the outer tube 3, and the thermal stress which is generated in the radial and axial directions within the intermediate tube 4 is generally absorbed and relieved by the notches 7*a* and 8*a* of the intermediate tube 4.

Thermal stress generation caused by thermal deformation of the honeycomb cores 1, 2 and the outer tube 3 is prevented, since they are not directly connected in the radial direction.

The effect of the expansion and contraction of the honeycomb cores 1 and 2 in the axial direction will now be considered. The axial expansion and contraction forces on the honeycomb cores 1 and 2 will be absorbed by the flexible portions 7, 8 and the notches 7*a*, 8*a* of the intermediate tube 4. The free ends 1*a* and 2*a* permit the axial expansion and contraction of the honeycomb cores 1 and 2, in order to relieve thermal stress on the honeycomb cores 1 and 2. As a result, the gaps G1 and G2 formed between the honeycomb cores 1, 2 and the outer tube 3, respectively, increase the durability of the metal substrate forming the honeycomb cores 1 and 2 and its ability to withstand heat stress caused by axial and radial thermal deformation.

The space G2 between the honeycomb cores 1, 2 and the outer tube 3 has an adiabatic function, whereby the heat transfer coefficient between the honeycomb cores 1, 2 and the outer tube 3 decreases. The outer tube 3 has a generally lower operating temperature than the honeycomb cores 1 and 2. In order to increase, or maintain the efficiency of the honeycomb cores 1 and 2, it is desirable to minimize the heat transfer between the outer tube 3 and the honeycomb cores 1 and 2.

The operating temperature of the honeycomb cores 1 and 2 rapidly increases following the starting of the engine E, and the purification process begins promptly thereafter. The internal temperature of the honeycomb cores 1 and 2 is maintained uniformly, so that thermal stress generated therein is significantly minimized.

The brazing material 11 through 13 is applied onto the intermediate tube 4 prior to brazing. Alternatively, the brazing material could be applied during the brazing precess. Furthermore, the advantages of the latter method include the even application of the brazing material, the ease with which is peeled off, and improved connection.

Figure 6:
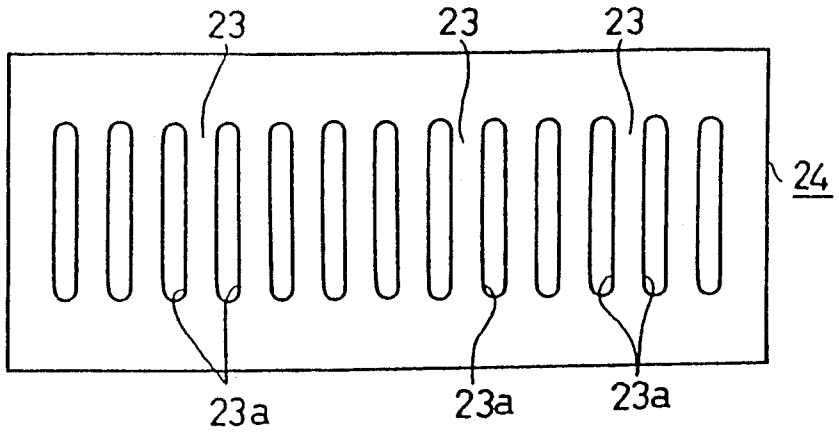
FIG. 6 is a plan view of yet another embodiment of an intermediate tube for use in the catalytic converter of FIG. 1.
Figure 5:
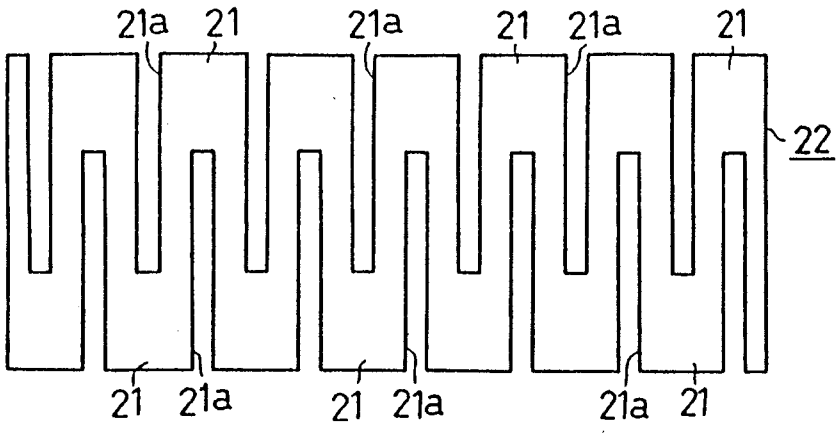
FIG. 5 is a plan view of another embodiment of an intermediate tube for use in the catalytic converter of FIG. 1, shown flattened.

FIGS. 5 and 6 describe two alternative embodiments of the intermediate plate. FIG. 5 shows a plurality of flexible portions 21 which are uniformly separated, and which are alternately interleaved with a plurality of notches 21*a*. These notches 21*a* are also uniformly separated from each other.

FIG. 6 shows a plurality of similar openings 23*a* which are uniformly distributed along the central section of the plate forming the intermediate tube. These openings 23*a* and flexible portions 23 form the central section of the plate.

Figure 8:
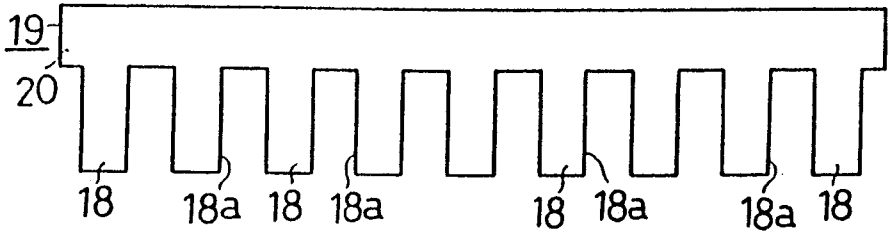
FIG. 8 is a plan view of an intermediate tube used in the catalytic converter of FIG. 7.
Figure 7:
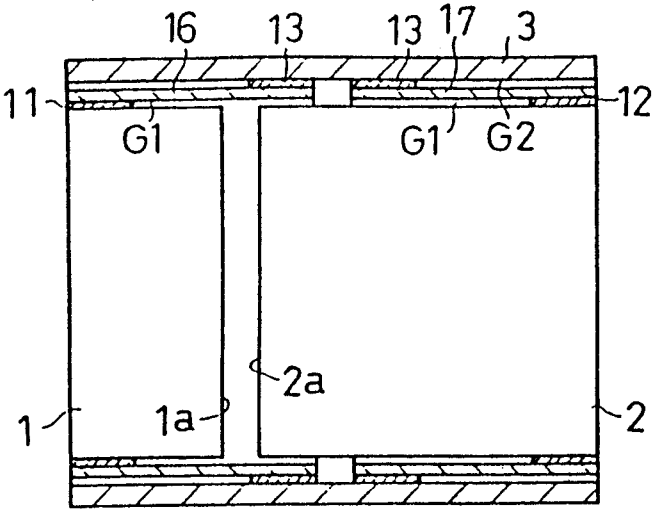
FIG. 7 is a sectional view of a second embodiment of a catalytic converter using the honeycomb cores of FIG. 2.
Figure 9:
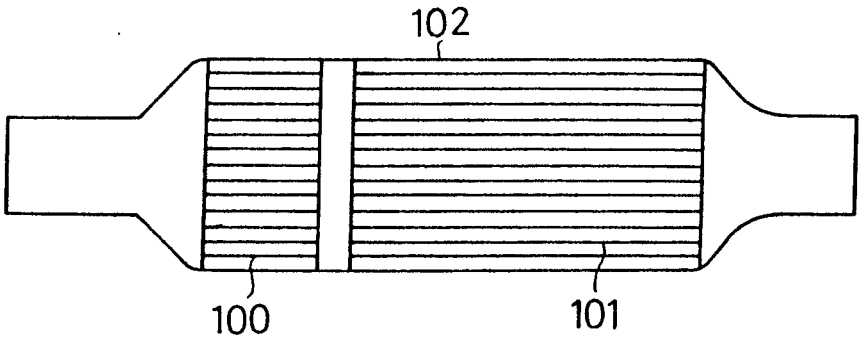
Fig. 9 (PRIOR ART)
FIG. 9 is a schematic side view of a conventional catalytic converter.

Turning now to FIGS. 7 and 8, they illustrate a second embodiment of a metal substrate according to the present invention. FIG. 7 shows a metallic substrate forming two intermediate tubes 16 and 17 which are disposed in corresponding relationship with the honeycomb cores 1 and 2. The intermediate tubes 16 and 17 are constructed with a plate made of stainless steel, and having a thickness ranging between 0.1 to 0.5 mm, or a plate made of a metal selected from a family of Fe-Cr-Al alloy material. The plate is subsequently rolled into a generally cylindrical shape.

FIG. 8 shows a plurality of flexible portions 18 which are uniformly formed at a single side of the intermediate tubes 16 and 17 in the axial direction. A plurality of similar flexible portions 18 are uniformly separated, and are interleaved with a plurality of notches 18*a*. These notches 18*a* are also uniformly separated from each other and are distributed along one end of a connecting section 20. The flexible portions 18 absorb, and allow for the expansion and contraction of the intermediate tubes 16 and 17.

As shown in FIG. 7, the inner peripheral ends of the intermediate tubes 16 and 17 are connected to the outer peripheral ends of the honeycomb cores 1 and 2 by means of brazing materials 11 and 12, respectively. In other words, the outer peripheral sides of the honeycomb cores 1 and 2 are brazed with the inner peripheral ends of the flexible portions 18. The central ends of the intermediate tube 16 and 17 are brazed to the inner side of the central section of the outer tube 3 by means of the brazing material 13. In other words, the middle portion of the outer tube 3 is brazed to the connecting section 20.

The general teaching for connecting the honeycomb cores 1 and 2, the outer tube 3 and the intermediate tubes 16 and 17, is similar to that previously described in connection with the first embodiment. Therefore, the durability of the metal substrate forming the honeycomb cores 1 and 2, and its ability to withstand heat stress caused by axial and radial thermal deformation, are increased.

Although only two embodiments of the present invention have been described, it should become apparent to those skilled in the art that the present invention may be embodied in many other specific forms without departing from the scope of the invention.

What is claimed is:

1. A catalytic converter for use in the gas exhaust system of an internal combustion engine, the converter comprising:

at least one pair of honeycomb cores disposed in the direction of flow of the exhaust gas as in the gas system, said honeycomb cores including a catalyst for purifying the exhaust gas;

an outer tube for housing said honeycomb cores; and an intermediate tube disposed between said outer tube and said honeycomb cores, said intermediate tube including a flexible section for absorbing dimensional variations in said honeycomb cores and said outer tube, wherein the coefficient of linear thermal expansion of said honeycomb cores is greater than that of said intermediate tube, and wherein the coefficient of linear thermal expansion of said intermediate tube is greater than that of said outer tube.

2. The converter according to claim 1, wherein said flexible section includes a plurality of flexible portions which are uniformly distributed along the periphery of said tube.

3. The converter according to claim 1, wherein said flexible section includes a plurality of flexible portions which are spaced apart by a plurality of openings, and wherein said flexible portions and openings are centrally disposed along the periphery of said intermediate tube.

4. The converter according to claim 1, wherein said honeycomb cores are selected from a family of Fe-Cr-Al alloy material, having a thickness of about 0.07 mm, wherein said intermediate tube is made of a stainless steel plate having a thickness ranging between 0.1 mm and 0.7 mm, and wherein said outer tube is made of a ferritic stainless steel plate having a thickness ranging between 1.0 mm and 2.0 mm.

5. The converter according to claim 2, wherein said honeycomb cores, said intermediate tube and said outer tube are connected by brazing.

6. The converter according to claim 5, wherein said intermediate tube, honeycomb cores, and said outer tube form gaps therebetween, and wherein the dimensions of said gaps correspond to the widths of a brazing material to be applied onto said intermediate tube.

7. The converter according to claim 2, wherein said honeycomb cores are selected from a family of Fe-Cr-Al alloy material having a thickness of about 0.07 mm; wherein said intermediate tube is made of a stainless steel plate having a thickness ranging between 0.1 mm and 0.7 mm; and wherein said outer tube is made of a Fe-Cr-Al alloy material having a thickness ranging between 0.1 mm and 0.5 mm; and wherein said outer tube is made of a ferritic stainless steel plate having a thickness ranging between 1.0 mm and 2.0 mm.

8. A catalytic converter for use in the gas exhaust system of an internal combustion engine, the converter comprising:

at least one pair of honeycomb cores disposed in the direction of flow of the exhaust gas in the gas system, said honeycomb cores including a catalyst for purifying the exhaust gas;

an outer tube for housing said honeycomb cores; and an intermediate tube disposed between said outer tube and said honeycomb cores, said intermediate tube including a flexible section or absorbing dimensional variations in said honeycomb cores and said outer tube, said intermediate tube, said honeycomb cores and said outer tube forming gaps therebetween, and wherein the widths of said gaps correspond to the widths of a brazing material to be applied to said intermediate tube, and wherein said flexible section of said intermediate tube includes a plurality of flexible portions spaced apart by a plurality of openings, said flexible portions and openings being centrally disposed along the periphery of said intermediate tube, and, wherein said intermediate tube is connected to said honeycomb cores and wherein said intermediate tube is further connected to said outer tube by means of said brazing material.

9. A catalytic converter for use in a gas exhaust system of an internal combustion engine having a roll-type honeycomb core including catalysts for purifying the exhaust gas, an outer tube accommodating said honeycomb core, and an intermediate tube having flexible sections disposed between said honeycomb core and said outer tube for absorbing the dimensional variation of the honeycomb core, wherein:

said honeycomb core includes a pair of honeycomb core members axially coaligned along the direction of flow of the exhaust gas;

each of said honeycomb core members include one free end, said free ends being oppositely disposed; and said intermediate tube has axially distal regions and a central region disposed between said distal regions, said distal regions being connected to the honeycomb core members and the central region being connected to the outer tube.

* * * * *

UNITED STATES PATENT AND TRADEMARK OFFICE

CERTIFICATE OF CORRECTION

PATENT NO. : 5,272,875

DATED : December 28, 1993

INVENTOR(S) : Gozo KAJI

It is certified that error appears in the above-indentified patent and that said Letters Patent is hereby corrected as shown below:

Column 1, line 35, change "catalatic" to --catalytic--.

Column 2, line 10, delete "to".

Column 2, line 50, change "an" to --a--.

Column 3, line 53, change "inner most" to --innermost--.

Column 4, line 2, change "ends," to --end,--.

Column 4, line 6, insert --end-- after "distal".

Column 4, lines 29 and 30, change "free one" to --one free--.

Column 5, line 39, insert --it-- after "which".

Column 7, line 2, change "claim 2" to --claim 1--.

UNITED STATES PATENT AND TRADEMARK OFFICE

CERTIFICATE OF CORRECTION

PATENT NO. : 5,272,875

DATED : December 28, 1993

INVENTOR(S) : Gozo Kaji

It is certified that error appears in the above-indentified patent and that said Letters Patent is hereby corrected as shown below:

Column 7, line 29, change "or" to --for--.

Signed and Sealed this

Twenty-sixth Day of July, 1994

*Attest:*

Bruce Lehman

BRUCE LEHMAN

*Attesting Officer*

*Commissioner of Patents and Trademarks*